United States Patent [19]

Chouinard

[11] Patent Number: 4,644,656

[45] Date of Patent: Feb. 24, 1987

[54] METHOD AND APPARATUS FOR DISASSEMBLY OF A SPOT-WELDED STRUCTURE

[76] Inventor: Michael J. Chouinard, 88 Milton St., Milton, Mass. 02186

[21] Appl. No.: 618,574

[22] Filed: Jun. 8, 1984

[51] Int. Cl.[4] ..... B26F 1/00

[52] U.S. Cl. ..... 30/362; 30/366

[58] Field of Search ..... 30/180, 358, 360, 362, 30/366, 368

[56] References Cited

U.S. PATENT DOCUMENTS

| | | | |
|---|---|---|---|
| 3,877,280 | 4/1975 | Cornell | 30/358 X |
| 3,924,330 | 12/1975 | Mitsuhashi et al. | 30/362 |
| 4,479,553 | 10/1984 | Virgili | 30/180 X |

*Primary Examiner*—Douglas D. Watts

*Attorney, Agent, or Firm*—Bromberg, Sunstein & McGregor

[57] ABSTRACT

A method and apparatus for removing spot welds from a sheet metal structure is shown. A fluid powered hand punch has a handpiece and an L-shaped extension forming a punch die. An elongated rod extends from a fluid piston within the handpiece to a punch bit, allowing the punch to be conveniently positioned over spot welds in diverse structures. An extension of the handpiece body guides and stabilizes the rod. Spot welds are removed by positioning the punch bit over the weld and entirely punching it out. A tapered punch bit engaging the metal along a partial perimeter of its front face is also shown.

3 Claims, 8 Drawing Figures

METHOD AND APPARATUS FOR DISASSEMBLY OF A SPOT-WELDED STRUCTURE

BACKGROUND OF THE INVENTION

The present invention relates to a method and apparatus for disassembly of sheet metal structures which have been spot welded together, and to a novel hand tool for performing such method in the auto body industry.

Spot welding is a widely used assembly technique for all manner of structures in which different sheets of metal must be fastened to each other. Examples of such structures are appliance cabinets, chassis for electronic parts, airplanes and perhaps most ubiquitously, automobile bodies. Spot welding is not only inexpensive and fast, but has the esthetic advantage of not involving fastener heads or other elements protruding above the surface of the sheet metal being fastened. In an automobile, numerous curved, stamped sheets of metal, such as those comprising fenders, rocker panels, reinforcements for the perimeter of the trunk, and other such pieces are spot welded into the final assembly at the factory. When an automobile is involved in a collision, or because of rust or deterioration requires replacement of such assemblies, the spot welded sheet must be separated from the undamaged portions of the vehicle and a new contoured sheet assembly must be installed. However, because the damaged assembly is spot welded, certain problems arise in disassembling the structure. With a simple bolted structure, it is common to burn off the bolt heads with an acetylene torch or to unscrew the bolts, allowing the sheets to simply separate. However, with the spot welded structure, the prevalent methods of disassembly are either tedious, or require force which may be destructive of other portions of the car.

One existing method is to painstakingly drill out each spot weld. Drilling out spot welds is accomplished by drilling first a small pilot hole through the middle of each spot weld and then using a circular piloted bit to entirely remove the weld from the exterior sheet. This operation must be done for each spot weld, to separate the portions of metal fused to the exterior sheet, after which the two sheets will simply separate. The protruding welds remaining on the lower sheet must then be ground flat. This process of removing welds, while resulting in a neat work product, is extremely tedious.

A second method of disassembling spot welded structures is to separate the two sheets at some point, and then to drive a dull chisel with a sharpened notch along the seam between the sheets so as to pry the sheets apart while severing the fused portions. Such a chisel, the use of which is now common together with a pneumatic handle assembly in auto body shops, is shown in U.S. Pat. No. 3,191,909 issued June 29, 1965 to N. M. Reischl. The use of a pneumatic chisel or parting tool in this manner, while effective, entails the use of force which may bend, rip or alter the underlying contour of the otherwise undamaged metal pieces, especially when used on the thinner gauge steels now common in the auto industry. Furthermore, such a parting tool and pneumatic hammer together form a rather bulky assembly, and may be serviceable only in situations where the spot welded seam is very exposed, without other structures or contours of the workpiece obstructing the area of work for a large distance on all sides.

A second specialized tool for disassembly of sheet metal structures operates with a rotary driver and essentially works in the manner of a sardine can opener. Such a device is shown in U.S. Pat. No. 3,688,383 issued Sept. 5, 1972 to A. M. Martin. It is not known whether the tool shown in that patent has been made or marketed; however that tool also involves parting the welds by force, essentially pulling them apart along a narrow band immediately surrounding the line of spot welds. In addition to exerting tearing force along the spot welds, that tool requires substantial clearance for insertion of the tool along the length of the seam, and also would appear to work only for the removal of a well exposed piece from another, substantially thicker, piece. As such, there are numerous portions of an automobile body, such as curved pieces, or pieces having vertical corners rising quite near to the spot weld, or pieces having spot welds situated at the base of a shallow channel or trench, as in the perimeter of a trunk compartment of an automobile, where none of the above specialized tools would work, and where the laborious drilling out of individual spot welds by hand would be the only practicable method, if any, of disassembly or of nondestructive disassembly. Finally a clamp-like structure having a pneumatically driven end mill has recently appeared on the market for removing spot welds. This device has the end mill and drive motor affixed to one arm of a C-shaped clamp, so as to be moved down toward the opposing arm of the clamp. As the clamp is closed, the mill cuts through one of a pair of spot welded sheets. That device is a logical extension of the usual art of drilling out welds, but is bulky, requires adjustment to suit the gauge of metal involved, is subject to bit wear, and may "skitter" on curved seams, or if incorrectly aligned.

BRIEF DESCRIPTION OF THE INVENTION

The present invention overcomes the disadvantages of the prior methods and devices by providing a method and device for disassembling spot welded structures by punching out the spot welds. A fluid actuated hand tool is configured with a narrow extension of the body extending between a fluid powered piston and a punch bit, so as to be able to reach normally inaccessible spot welded seams in an automobile body and conveniently punch out the fused spot welds along the edges of the sheet assemblies. The punch device has a hand piece with machined fluid cylinder formed therein and a piston with a long nosepiece or rod, to which a punching element is mounted. An L-shaped member extends from one end of the hand piece along one side thereof, defining, together with the hand piece, a work-receiving throat, with the horizontal portion of the L defining an anvil including a punch die aperture. The piston nosepiece or rod is guided by the central narrow extension of the hand piece and, in one embodiment, is adapted to threadedly receive replaceable punch tools, which are preferably of a shearing, rather than straight punching, profile to minimize power requirements of the tool. A tool steel die plate is mounted on the anvil and the entire anvil structure extends only a small amount radially beyond the edges of, or axially below the surface of, the die aperture, so that the punch may conveniently be positioned over spot welds within a fraction of an inch of obstructions. A trigger may be provided in the hand piece.

BRIEF DESCRIPTION OF THE DRAWINGS

These and other features of the invention will be appreciated by reference to the drawings, in which.

DESCRIPTION OF THE INVENTION

Figure 1:
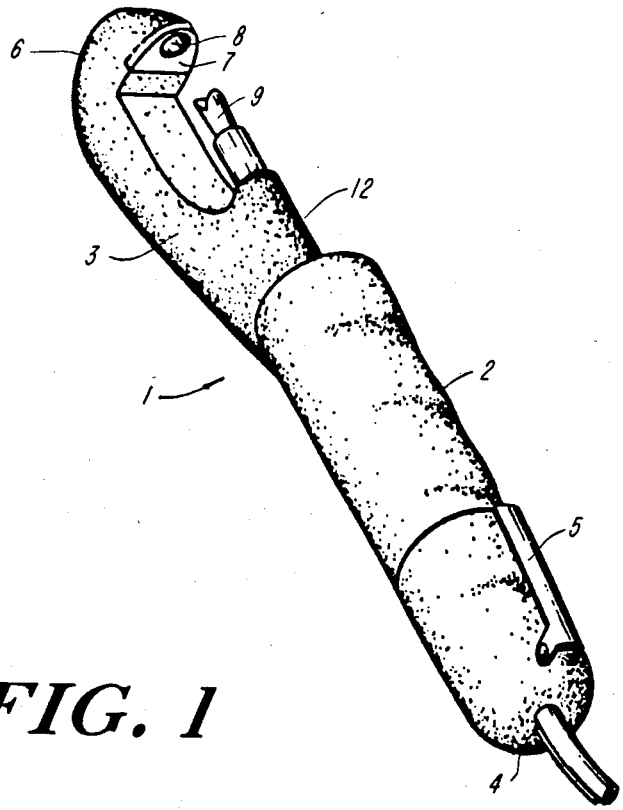
FIG. 1 shows a perspective view of the punch used in the method according to the present invention.

Turning now to FIG. 1 there is shown a perspective view of a fluid actuated punch for use in removing spot welds according to the present invention. As shown, the punch 1 comprises a hand piece portion 2 and an L shaped portion 3 extending from one end of the hand piece. The hand piece has a fluid inlet 4 which is preferably an inlet for hydraulic fluid having a substantial pressure in the range of 2 to 10,000 PSI (125–700 atmospheres). As shown, the device is a hand tool of a size to be gripped in the palm of one hand, with a hydraulically actuated piston for driving the punch. The small size of the device dictates the relatively high hydraulic fluid pressure required to operate it. As shown in FIG. 1, a preferred embodiment of the device incorporates a trigger handle 5 which is actuable by the hand holding the device, and which controls the provision of pressurized fluid to the piston within, by bearing against a button valve located under the handle. It is not necessary that the valve directly control the hydraulic fluid, but may rather control a pneumatic source, or even an electrical contact, which regulates a remote device which provides, in turn, the surges of hydraulic fluid under pressure for powering the punch. The L shaped extension 3 has a horizontal portion 6 projecting outwardly therefrom so as to define a throat for receiving a workpiece. The inner face of the horizontal portion 6 is an anvil 7 or flat surface having an aperture 8 therein, through which the punch tool 9 passes for punching sheet metal. As shown, the hand piece 2 is of a substantially cylindrical shape having a longitudinal axis. The body of the handpiece between the piston and the anvil includes an extension portion 12 of the hand piece with an exterior profile inwardly offset from that of the hand piece and with a bore therein for accommodating and guiding the punch tool. In a preferred embodiment, the punch tool itself is a small hardened steel element, preferably configured for shearing rather than straight punching action, and adapted to replaceably mount in the piston element (not shown). The efficiency of a punch mechanism, and the longevity of the punch bits, critically depend on the alignment of the punch bit with the die hole, so that the bit does not either strike into the die plate, or strike the metal at a distance too far removed from the edge of the die aperture to allow efficient cutting action. Accordingly, the extension portion 12 serves a function of stabilizing the punch bit assembly to provide such stability and tool longevity; the guide extension comprises a thin wall, approximately 1/10" (1.5 mm) thick, chosen as the minimal diameter housing necessary to accomplish this result, so as to provide the maximum clearance around the sides of the throat for positioning the device in proximity to sheet metal assemblies of diverse shapes.

Figure 2:
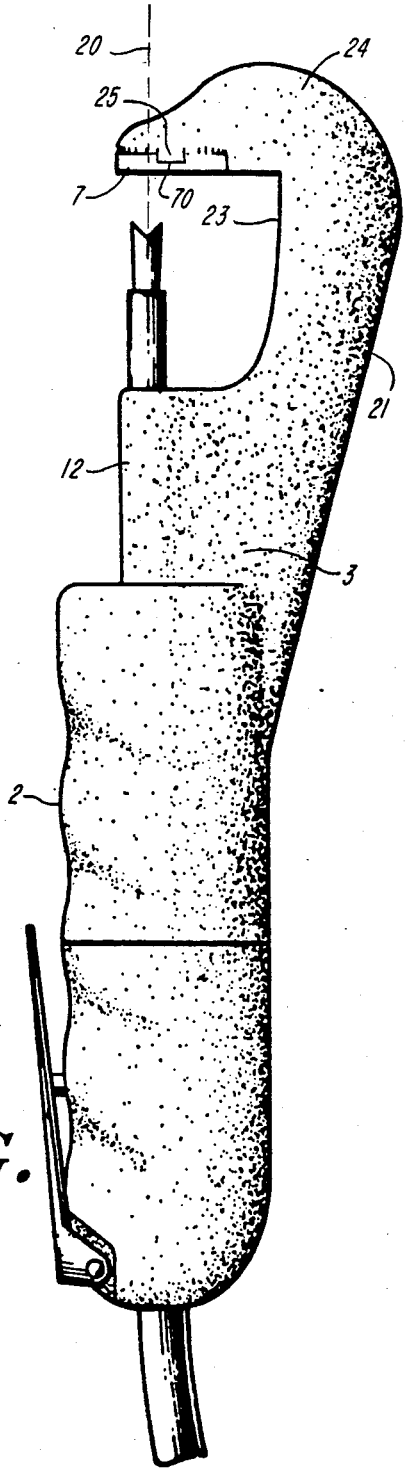
FIG. 2 shows a side view of the punch of FIG. 1.

Turning now to FIG. 2 there is shown a side view of the fluid actuated punch of the present invention, showing the side profile of the workpiece-receiving throat defined by the hand piece 2, the extension 12, and the L shaped member 3. As shown, the central axis 20, along which the punch bit moves, extends quite close to the leading edge of the die plate 7. Also, the exterior edge of the extension 12 lies along an axis also quite close to the central axis 20. This results in a relatively thin wall around the central bore (not shown) which accommodates and guides the tool bit and the structure attached to it; the choice of such a minimal exterior contour is done to permit the maximum amount of clearance of the hand tool, as a whole, in relation to possibly abutting sheet metal assemblies which it may be required to punch. Die plate 7 is formed of tool steel, tempered and hardened so that it is hard enough to use for the die aperture, yet tough and resistant to cracking and chipping. In the embodiments shown die plate 7 is approximately 3/32 inch in thickness and preferably is attached to the anvil formed by the horizontal portion of the L shaped extension with a weld having a low melting point, such as a braze or silver solder. The weld serves to efficiently convey the forces exerted on the die plate to the underlying casting, and is chosen to have a low melting point so as not to adversely affect the hardness and toughness of the plate 7, and to permit replacement or interchange of the plate. To aid in the alignment of plate 7, a groove 70 is rabbeted therein. Groove 70 slides over a corresponding raised ridge or boss 25 of the handle, thereby aligning the plate along a line through the axis of the punch. Because the plate 7 is welded to the underlying casting, no bolt or fastener holes need be drilled in the casting of the L shaped member. For this reason the underlying casting or support region of the L may be made quite thin, and still be strong; in addition the cumbersome die jigs of the prior art are eliminated, resulting in the increased maneuverability required of the hand tool. As shown, a clearance, below the sheet being punched, of less than approximately $\frac{1}{4}$ inch is all the tool requires; this is in sharp contrast to existing punches which have a reinforced casting of substantial depth on the die plate side. Further contributing to the compactness of construction is the shape of punch tool 9. The preferred contour of the punch bit will be discussed below in relation to FIG. 4; at this point it suffices to say that the bit is configured with advance portions which engage the sheet metal for shearing along a portion of the hole perimeter, rather than punching through the entire hole at once. The punch bit thus requires less force than if the bit were configured for straight punching rather than shearing action.

Figure 3:
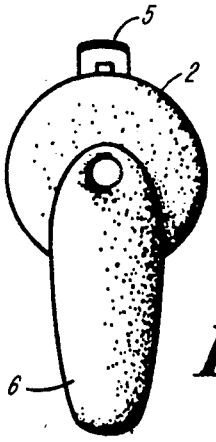
FIG. 3 shows an end view of the punch of FIG. 1.

FIG. 3 shows an end view, from the anvil end, of the fluid powered punch of the embodiment of FIGS. 1 and 2. As shown, the horizontal portion 6 of the L-shaped extension is of a narrow cross section extending in a narrow angular range on one side of the axis of the punch. The portion 6 extends only so far as is necessary to define the die aperture 8, and is gently radiussed so as to allow placement of the punch aperture within approximately $\frac{1}{8}$" of an obstructing surface oriented parallel to the punch axis for approximately 270 degrees of arc around the aperture. By contrast, the handpiece 2 extends approximately $\frac{1}{2}$–$\frac{3}{4}$ inches (1–2 cm) out from the axis in all directions. Trigger 5 is shown mounted on handpiece 2 on a side opposing the L-shaped member 3; however the location of trigger 5 is a matter of choice.

Figure 4:
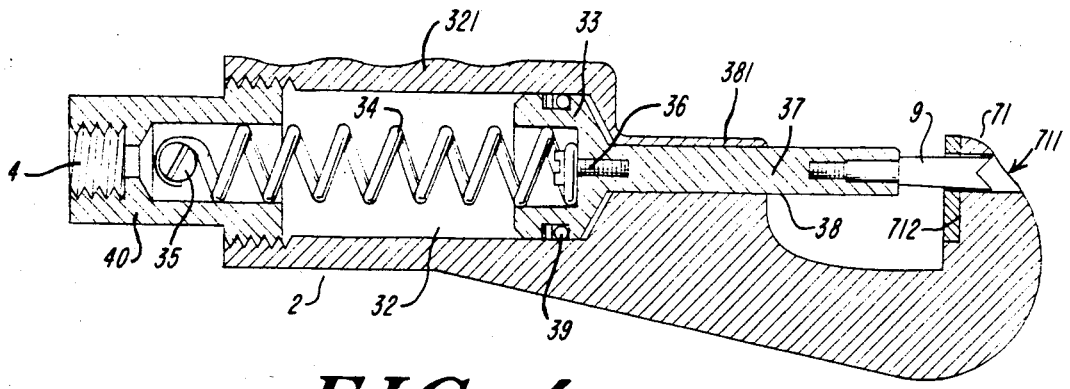
FIG. 4 shows a section through the hand piece of the punch including the piston structure.

Turning now to FIG. 4 there is shown a section through the hand piece and piston. As shown, hand piece 2 comprises a fluid inlet 4 to a central chamber 32. The chamber is a cylindrical bore and accommodates therein a piston 33 of a diameter corresponding to the chamber. Piston 33 is attached to a spring 34 the other end of which is anchored via a set screw 35 to the inner cylinder wall at the inlet end of the chamber. Access to the screw 35 is via a threaded bore horizontally directed to the opposing side wall of the chamber, which in turn is closed with a plug (neither shown). The piston end of the spring is preferably bolted to the piston by a similar screw or bolt 36. As shown piston 33 has a first end substantially of the same diameter as the inner diameter of central chamber 32. This end acts as a hydraulic piston and serves, under the influence of fluid pressure, to advance the tool bit. Extending downward from piston 33 is a nosepiece 37 which extends approximately 2 inches (5 cm) from the face of the piston. The nosepiece 37 is in the form of a thin rod, which advantageously may be of a length between approximately ½" and 4" without departing from the scope of the present invention. The tip of nosepiece 37 preferably has a central bore threaded therein for receiving punch bits. Nosepiece 37 projects through extension guide bore 38 formed in the housing at region 12, thereby stabilizing and enhancing the accuracy of the punch bit holding member. Also shown in FIG. 4 is the punch bit 9, which, as shown, has a V-shaped notch at the front cutting edge thereof, a slightly tapered body extending back toward its other end, a first cylindrical shank, and finally a second narrower cylindrical portion which is threaded for mounting in the threaded bore of the nosepiece. The taper of the bit assures that it will not bind in the punched hole, so that a mild spring 34 may be of sufficient strength to retract the cutting face of the bit within, and almost up to the face of the hole, after a punching operation. A slight motion of the handpiece then suffices to entirely disengage the bit from the punched hole. In this manner use of the bulky spring-loaded die jigs and ejector mechanisms of the prior art is avoided. Sealing ring 39 is shown surrounding the piston so as to prevent leakage of fluid from the chamber past the piston. Ring 39 may be replaced by any conventional hydraulic sealing ring assembly, which may include one or more wipers and seals, in one or more grooves of the piston.

FIG. 4 shows in detail the manner in which the casting walls around the above-described bores and chambers are minimized so as to provide a hand tool capable of punching spot welds from contoured sheet assemblies. In particular, the wall 321 defining the central chamber is thin, so that a maximum possible diameter piston 33 may be used while still maintaining sufficiently small dimensions to allow the device to be held in one hand. Similarly, the wall 381 defining the extension guide bore is, except on the side of the tool having the L shaped or goose neck extension, even thinner. The purpose of the L-extension is to define a work-receiving throat removed from, and offset clear of, the side of the piston, so that the handpiece radius of approximately ¾" will not pose a lower limit to the range of accessible punching locations. This extension portion serves to maintain the nose portion of the piston in axial alignment, and, except for slight deflections upon initial punching impact, receives little, if any, force. Finally, the anvil nose portion 71 is also quite thin, and the punch die hole situated very near to the edges thereof, both of which features serve to permit the device to be used on spot welded seams, even those having a vertically-rising surface abutting the welds, or welds located on curved surfaces. The nose has an aperture 711 formed therein coaxial with the bit. This entire anvil portion of the handpiece may be forged, and the die plate 7 dispensed with. However, preferably, die plate 7 is used. The die plate 7 is preferably rabbeted 712, and receives a corresponding boss milled on the casting, for ease of alignment when replaced.

Figure 5:
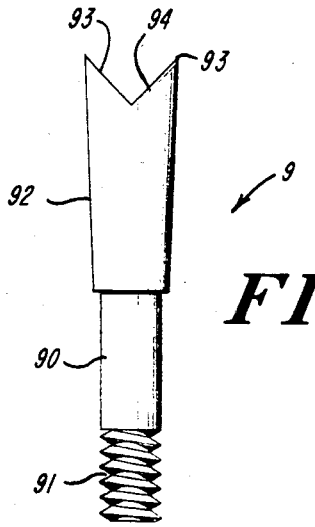
FIG. 5 shows a preferred punch bit for use in the device.

Turning now to FIG. 5 there is shown an enlarged detail of a preferred punch bit 9 used in the practice of the present invention. As shown, the punch bit 9 is a replaceable bit, having threads 91 at one end thereof, a cylindrical shank, 90, and a body 92 tapering outwardly towards the cutting end of the bit. The cutting end has a V shaped cross section 94 so as to engage the work piece at opposing beveled edges 93, thereby instituting a shearing, rather than a straight punching action, only along a partial perimeter of the hole to be punched, at a given instant, thus requiring less punching force than otherwise. Other configurations of the cutting face known in the art for producing a progressive shearing action are also suited to this punch. The taper along portion 92 assures that after the punch has penetrated the sheet metal, the edges of the punch do not engage the metal or jam in the hole.

The fluid powered punch for the use in accordance with the present invention may, as discussed above, incorporate a trigger for turning on and off the pressurized fluid, in a manner well known in the art. It is envisaged that, as adapted for use in an auto body shop, the punch may be operated from an auxiliary hydraulic step-up unit, similar in operation to an automotive power brake unit, in which a source of pressurized air at approximately 100 PSI is used to drive a single-displacement piston pump to produce the necessary hydraulic fluid pressure at several thousands of PSI. Alternatively the tool may be attached to an electrically-driven hydraulic pump to attain the necessary operating pressures. In either of these two cases the trigger assembly would be operative to open or close a valve for the auxiliary air source, or to close an electrical contact for actuating the auxiliary fluid power device. Alternatively, the trigger could directly open a fluid pressure valve.

The construction details of an illustrative embodiment of the punch tool configured for removing spot welds having been discussed in detail in relation to FIGS. 1–5, the operation of the tool and several illustrative examples of its use in effecting the method of the present invention will now be discussed in relation to FIGS. 6, 7 and 8 below.

Figure 6:
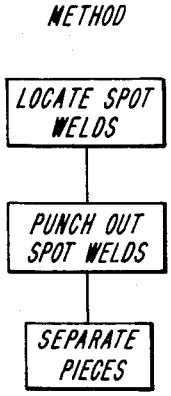
FIG. 6 is a diagram of the steps involved in the method of separating spot welded metal according to the present invention.

FIG. 6 shows the logical sequence of steps of the method, according to the present invention, for separating spot welded structures. As shown, the method comprises the steps of locating the spot welds joining a piece to the structure; placing the punch over each such spot weld and entirely punching out the fused metal; and separating the structures when all welds have been thus removed. While simple in approach, punching as a technique for removing spot welds has not been done before because spot welding is used precisely for structures unsuitable for conventional punches, which, as a rule, have a die block or narrow sheet-receiving die portion which will not accommodate a typical assembled spot welded structure.

Figure 7:
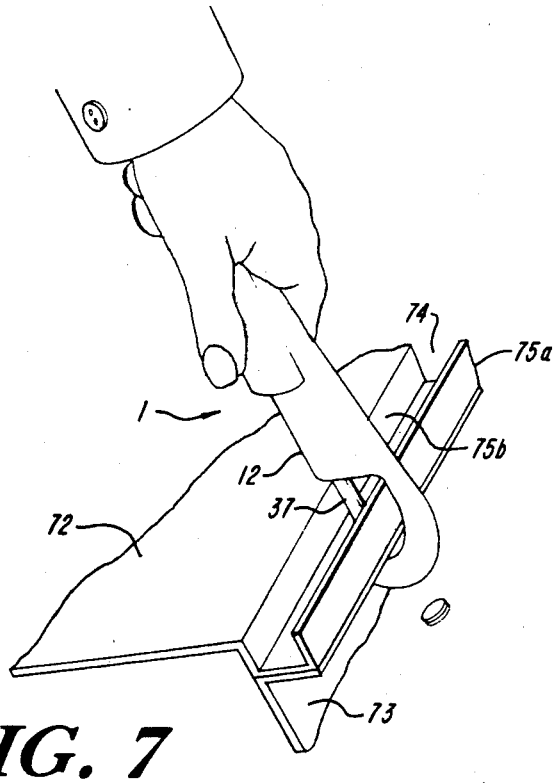
FIG. 7 shows the method and punch applied to a spot welded assembly.

FIG. 7 shows one example of such a configuration, and the use of the tool of the present invention for removing spot welds. As shown, a first piece 72 having a U-shaped channel 74 is spot-welded along the bottom of channel 74 to a second, L-shaped, piece of metal 73. The U-shaped channel 74 has vertically-rising sides 75*a*, 75*b* which would clearly prevent access to a conventional punch. As shown in FIG. 7, the punch 1 according to the present invention can conveniently punch the spot welds from the bottom of channel 74 because the nosepiece 37, in sharp contrast to the punch bit holder or die block assembly of the prior art, can fit into a narrow channel.

Figure 8:
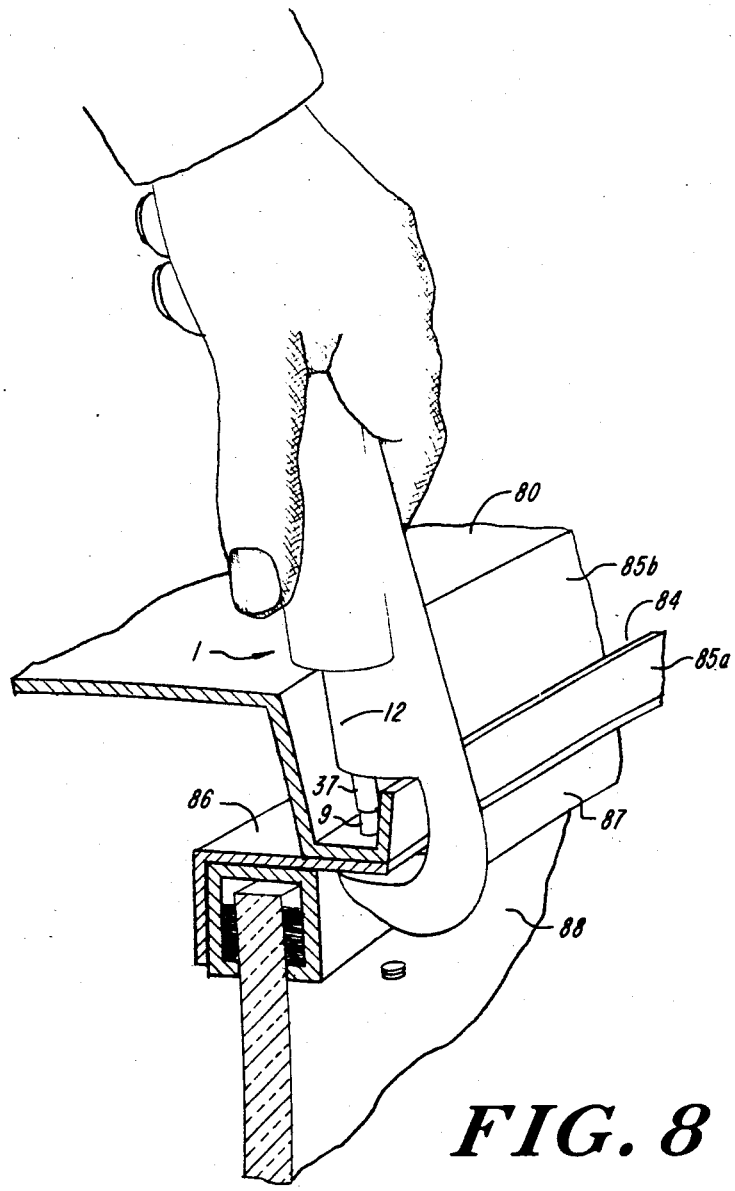
FIG. 8 shows the method and punch applied to another assembly.

This feature is more clearly indicated in FIG. 8, in which a typical automotive roof panel 80 is shown, having a rain channel 84 with a vertical roof face 85*b* and a vertical channel face 85*a*. The face 85*b* may rise vertically several inches or more (over 5 cm) and the channel 84 may be as narrow as 5/16 inch (8 mm) or less. Roof panel 80 is joined to body member 86 which in turn holds window frame 87 surrounding a sheet of glass 88. The plane defined by sheet 88 may be within ¼" of the vertical plane passing through the line of spot welds in the bottom of channel 84. In such a situation the window would entirely prevent use of a tool extending ¼" beyond the punch axis, so that the handle could not be oriented downward. The vertical roof face 85*b* poses a similar restraint on the tool. As shown, the tool of the present invention, having extension portion 12 housing the nosepiece 37, is not obstructed by such an assembly of welded sheet metal structures and accordingly is operative to remove the spot welds and separate the sheets.

What is claimed is:

1. A fluid operated metal punching device for punching spot welds from assembled sheet metal assemblies, the device comprising:

a handpiece having a longitudinal axis;

a head mounted on the handpiece and having (i) front and rear faces;

(ii) a cutout portion in the front face defining upper and lower jaws of the head, the lower jaw being proximate to the handpiece and the upper jaw being distal therefrom;

(iii) a cutting element, movably mounted in the lower jaw of the head along a punching axis substantially parallel to the front face of the head and proximate thereto and parallel to the longitudinal axis of the handpiece;

(iv) actuating means, mounted in the lower jaw of the head, for urging the cutting element, along the punching axis, toward the upper jaw;

the upper jaw having an aperture therein defining a punch die into which the cutting element may be urged, so that when material is placed between the jaws the actuating means may urge the cutting element to punch a hole in the material, the upper jaw further including a die plate attached thereto with a weld with a low melting point, the die plate further including a groove rabbeted therein for alignment purposes.

2. A fluid operated metal punching device for punching spot welds from assembled sheet metal assemblies, the device comprising:

a handpiece having a longitudinal axis;

a head mounted on the handpiece and having (i) front and rear faces;

(ii) a cutout portion in the front face defining upper and lower jaws of the head, the lower jaw being proximate to the handpiece and the upper jaw being distal therefrom;

(iii) a cutting element, movably mounted in the lower jaw of the head along a punching axis substantially parallel to the front face of the head and proximate thereto and parallel to the longitudinal axis of the handpiece;

the cutting element having first and second ends, the first end being movably mounted in the lower jaw of the head along a punching axis substantially parallel to the front face of the head and proximate thereto, and the second end having a notch therein with a generally V-shaped profile so as to define a pair of cutting edges at the second end;

the cutting element further having a longitudinal profile that is tapered from the first end toward the second end, so that the first end has a larger cross-sectional area than that of the cutting element in regions distal from the first end;

(iv) actuating means, mounted in the lower jaw of the head, for urging the cutting element, along the punching axis, toward the upper jaw;

the upper jaw having an aperture therein defining a punch die into which the cutting element may be urged, so that when material is placed between the jaws the actuating means may urge the cutting element to punch a hole in the material.

3. A fluid operated metal punching device for punching spot welds from assembled sheet metal assemblies, the device comprising:

a handpiece having a longitudinal axis;

a head mounted on the handpiece and having (i) front and rear faces;

(ii) a cutout portion in the front face defining upper and lower jaws of the head, the lower jaw being proximate to the handpiece and the upper jaw being distal therefrom;

(iii) a cutting element with first and second ends, the first end movably mounted in the lower jaw of the head along a punching axis substantially parallel to the front face of the head and proximate thereto, and the second end having a notch therein with a generally V-shaped profile so as to define a pair of cutting edges at the second end;

the cutting element further having a longitudinal profile that is tapered from the first end toward the second end, so that the first end has a larger cross-sectional area than that of the cutting element in regions distal from the first end;

(iv) actuating means, mounted in the lower jaw of the head, for urging the cutting element, along the punching axis, toward the upper jaw;

the upper jaw having an aperture therein defining a punch die into which the cutting element may be urged, so that when material is placed between the jaws the actuating means may urge the cutting element to punch a hole in the material.

* * * * *